US012419432B1

(12) United States Patent
Hughes

(10) Patent No.: US 12,419,432 B1
(45) Date of Patent: Sep. 23, 2025

(54) BED PARTITION DEVICE AND METHODS OF USE THEREOF

(71) Applicant: Bret Hughes, Pompano Beach, FL (US)

(72) Inventor: Bret Hughes, Pompano Beach, FL (US)

( * ) Notice: Subject to any disclaimer, the term of this patent is extended or adjusted under 35 U.S.C. 154(b) by 112 days.

(21) Appl. No.: 18/403,869

(22) Filed: Jan. 4, 2024

Related U.S. Application Data

(60) Provisional application No. 63/461,822, filed on Apr. 25, 2023, provisional application No. 63/438,634, filed on Jan. 12, 2023.

(51) Int. Cl.
*A47C 21/00* (2006.01)

(52) U.S. Cl.
CPC ..... *A47C 21/00* (2013.01)

(58) Field of Classification Search
CPC ..... A47C 21/00
USPC ..... 5/513
See application file for complete search history.

(56) References Cited

U.S. PATENT DOCUMENTS

| | | | | |
|---|---|---|---|---|
| 2,471,977 | A * | 5/1949 | Albert | A47C 21/00 211/184 |
| 2,556,913 | A | 6/1951 | Gilbert | |
| 2,704,371 | A | 3/1955 | Liphart | |
| 3,592,289 | A | 7/1971 | Aysta et al. | |
| 4,109,331 | A | 8/1978 | Champeau | |
| 6,510,572 | B2 | 1/2003 | Horowitz | |
| D867,772 | S | 11/2019 | Sakich et al. | |
| 2008/0276371 | A1 | 11/2008 | Stowers | |
| 2011/0186241 | A1 | 8/2011 | Sewell et al. | |
| 2016/0017631 | A1 | 1/2016 | Gilmore | |

* cited by examiner

*Primary Examiner* — Adam C Ortiz
(74) *Attorney, Agent, or Firm* — John Rizvi; John Rizvi, P.A.—The Patent Professor®

(57) ABSTRACT

A bed partition device and methods of use thereof are provided that are capable of quickly and efficiently dividing a bed into two sections for the convenience and comfort of individuals resting on the bed. The bed partition device may include a wall having a rigid body and configured to provide acoustic dampening between the two sections of the bed, a pair of mounting brackets secured to the wall, and a pair of support members configured to releasably couple with the pair of mounting brackets and thereby support the wall. The wall may comprise two or three partitions coupled to each other with fasteners, where the partitions may fold upon each other into a folded position.

18 Claims, 9 Drawing Sheets

BED PARTITION DEVICE AND METHODS OF USE THEREOF

CROSS-REFERENCE TO RELATED APPLICATIONS

This application claims the benefit of U.S. Provisional Patent Application Ser. No. 63/438,634 filed on Jan. 12, 2023 and U.S. Provisional Patent Application Ser. No. 63/461,822 filed on Apr. 25, 2023 which are both incorporated by reference herein in their entirety.

FIELD OF THE INVENTION

The present invention relates generally to bed accessories, and more particularly, to a bed partition device configured to divide a bed into two sections for the convenience and comfort of individuals resting on the bed.

BACKGROUND OF THE INVENTION

Individuals who sleep together in a single bed may occasionally disturb each other in various manners. In particular, a sleeping individual may be woken by light or sound produced by the other individual who is awake in the bed and performing other activities. For example, an individual watching television, using a lamp for reading, or using another electronic device (e.g., tablet, computer, phone, flashlight, etc.) that emits light or sound may disturb the sleeping individual. Even natural sounds produced by one sleeping individual such as snoring or repositioning on the mattress may disturb the other sleeping individual.

Various solutions to situations such as these are available but may be undesirable. For example, the individuals may sleep in separate beds and/or rooms. However, this may not always be possible if limited beds and/or rooms are available. Further, for certain individuals such as married couples, sleeping in separate beds and/or rooms may have negative effects on their relationship. For individuals intending to perform activities other than sleeping, such individuals may leave the bed and perform such activities elsewhere. However, this may be inconvenient, especially if the individual is attempting to fall back to sleep.

In addition to the above solutions, various devices are commercially available that are intended to address these and similar problems. For example, a sleeping individual may wear ear plugs and a sleeping mask to reduce their likelihood of being disturbed by sound and light, respectively. However, these devices may be uncomfortable and reduce the ease by which the individual can fall asleep.

Accordingly, there is an established need for devices and/or methods capable of reducing the likelihood that light and/or sound produced on one side of a bed will disturb an individual on another side of the bed.

SUMMARY OF THE INVENTION

The present invention is directed to a convenient bed partition device that is capable of quickly and efficiently dividing a bed into two sections for the convenience and comfort of individuals resting on the bed. The bed partition device may include a wall having a rigid body and configured to provide acoustic dampening between the two sections of the bed, a pair of mounting brackets secured to the wall, and a pair of support members configured to releasably couple with the pair of mounting brackets and thereby support the wall.

In a first implementation of the invention, a bed partition device for dividing a bed into two sections comprises a wall having a rigid body and configured to provide acoustic dampening between the two sections of the bed, wherein the rigid body is comprised of an upper edge, a lower edge and a side edge, a pair of mounting brackets secured to the wall, and a pair of support members configured to releasably couple with the pair of mounting brackets and thereby support the wall.

In a second aspect, the wall can include two or more panels configured to be releasably coupled to each other with one or more fasteners.

In another aspect, the two or more panels may be coupled with a plurality of hinges, where the plurality of hinges enable the two or more panels to fold upon themselves into a folded position.

In another aspect, the two or more panels may include a body formed of a polymeric material and a rigid, polymeric, metallic, or composite frame secured about a perimeter of the body.

In another aspect, the upper edge of the rigid body may include an upper portion and a lower portion, wherein the upper portion is taller than the lower portion.

In another aspect, the wall may include a fabric material releasably coupled to the rigid body thereof, and the fabric material may be configured to dampen acoustics.

In another aspect, the fabric material may be coupled to the rigid body of the wall with hook and loop fasteners.

In another aspect, the brackets may include elongated rails and the support members may include channels or slots configured to receive the elongated rails.

In another aspect, the support members may be configured to be secured to a frame of the bed.

In another aspect, the support members may be configured to rest on a surface below the bed.

In another aspect, the support members may include a first section and a second section, the first section may be configured to rest on a frame of the bed and have a mattress of the bed rest on the first section such that the first section is between the frame and the bed, and the second section may be configured to couple with the mounting brackets.

In another aspect, the first section and the second section may be oriented substantially perpendicular to each other, and the second section may be configured to extend along edges of the mattress.

In a first implementation of the invention, a method for dividing a bed into two sections comprises providing a bed partition device that includes, a wall having a rigid body and configured to provide acoustic dampening between the two sections of the bed, a pair of mounting brackets secured to the wall, and a pair of support members. The method comprises locating the wall above and along a mattress of the bed such that the wall extends above the mattress and separates the mattress into the two sections, releasably coupling the pair of mounting brackets to the pair of support members, and supporting the wall above the mattress with the support members.

In another aspect, the method may include assembling the wall by releasably coupling two or more panels to each other.

In another aspect, the two or more panels may include a body formed of a polymeric material and a rigid, polymeric, metallic, or composite frame secured about a perimeter of the body.

In another aspect, the method may include releasably coupling a fabric material to the rigid body of the wall, and the fabric material may be configured to dampen acoustics.

In another aspect, releasably coupling the fabric material to the rigid body may include coupling hook and loop fasteners fixed to the fabric material and the rigid body.

In another aspect, releasably coupling the pair of mounting brackets to the pair of support members may include inserting elongated rails of the pair of mounting brackets into channels or slots of the support members.

In another aspect, the method may include securing the support members to a frame of the bed.

In another aspect, the method may include positioning the support members to rest on a surface below the bed.

In another aspect, the support members may include a first section and a second section, and the method may include positioning the first section to rest on a frame of the bed, positioning a mattress of the bed to rest on the first section such that the first section is between the frame and the bed, and releasably coupling the pair of mounting brackets to the second section of the pair of support members.

In another aspect, the first section and the second section may be oriented substantially perpendicular to each other, and the method may include positioning the support members such that the second section extends along edges of the mattress.

In another aspect, a bed partition device for dividing a bed into two sections may comprise a wall having a rigid body and configured to provide acoustic dampening between the two sections of the bed, wherein the rigid body is configured between an upper edge, a side edge and a lower edge; a fabric material releasably coupled to the rigid body, wherein the fabric material is configured to dampen acoustics between the two sections of the bed; a pair of mounting brackets secured to the wall; and a pair of support members configured to releasably couple with the pair of mounting brackets and thereby support the wall.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a convenient and economical bed partition device that is capable of dividing a bed into two or three sections. With the bed partition device installed, individuals may rest on the bed with the bed partition device located therebetween. The bed partition device promotes comfort of the individuals by providing a physical barrier therebetween which further promotes light blocking and acoustic dampening. In this manner, the individuals may simultaneously rest on the bed with a reduced likelihood of disturbing each other.

Figure 1:
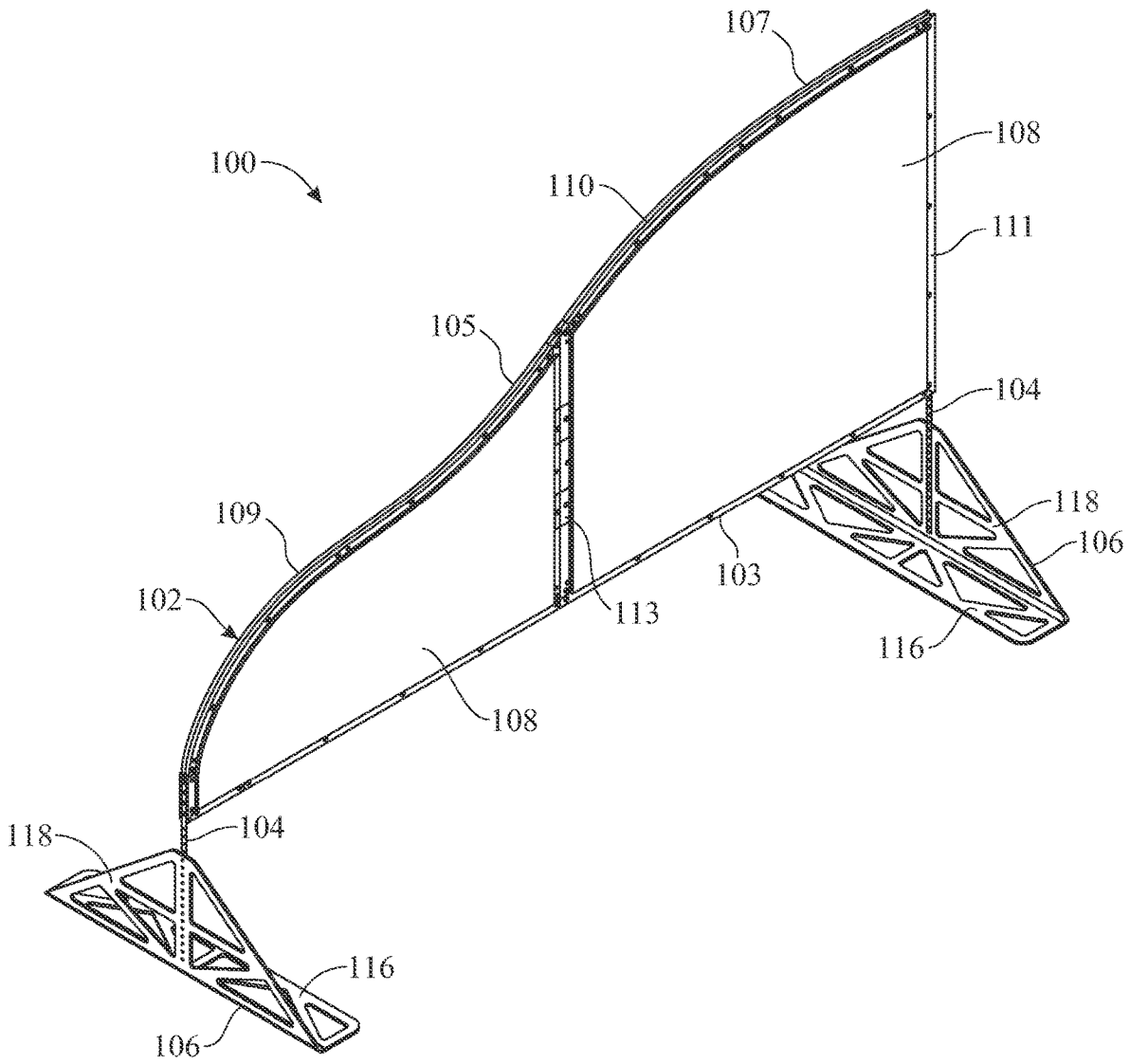
FIG. 1 presents a perspective view of a bed partition device in accordance with a first embodiment of the present invention.
Figure 2:
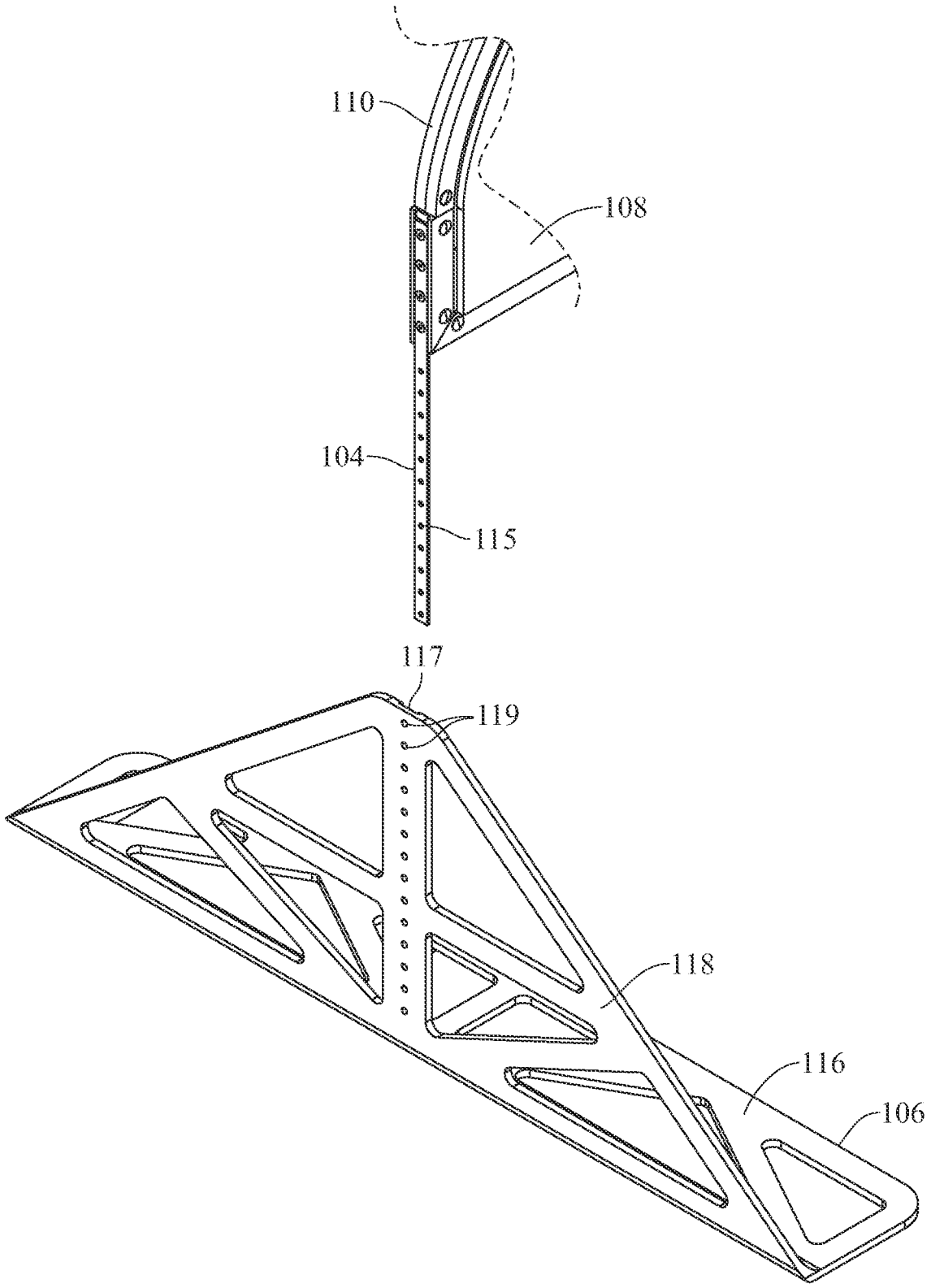
FIG. 2 presents an isolated, perspective view of a support member and bracket of the bed partition device of FIG. 1.
Figure 3:
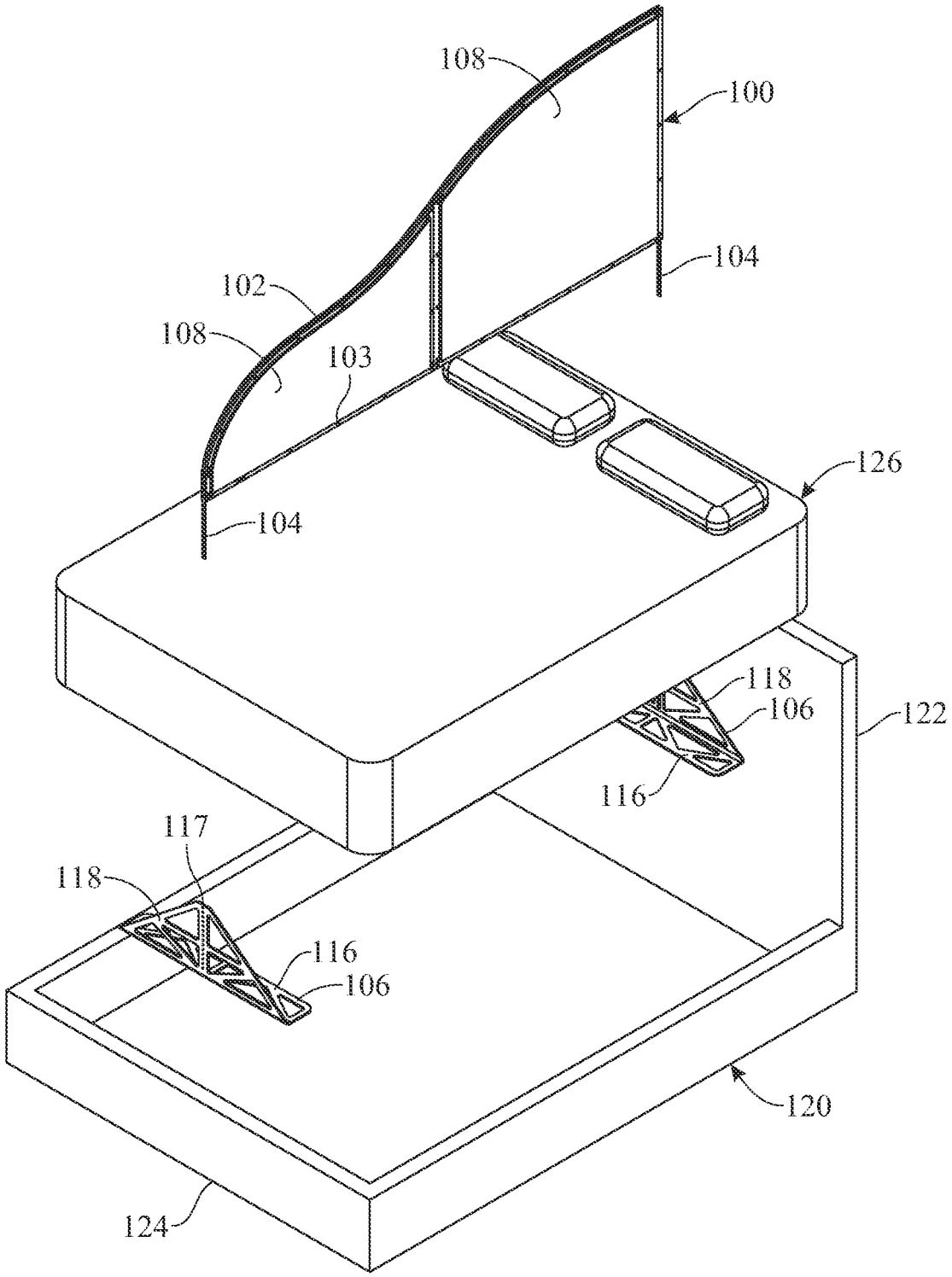
FIG. 3 presents an exploded, perspective view of the bed partition device and a bed that illustrates a method of installing the bed partition device in accordance with a second illustrative embodiment of the present invention.

Referring initially to FIGS. 1 and 2, a nonlimiting example of the bed partition device, referred to herein as the bed partition device 100, is presented that includes a wall 102, a pair of mounting brackets 104 secured to the wall 102, and a pair of support members 106 configured to couple with the mounting brackets 104 to support the wall 102 in an upright position.

For convenience, the bed partition device 100 will be discussed in relation to an installation of the bed partition device 100 with a bed as presented, for example, in FIGS. 4-6. In general, the bed includes a bed frame 120 configured to support a mattress 126 in an elevated position above a surface, for example, a floor in a house, hotel, or other structure. In this example, the bed frame 120 includes a headboard 122, a footboard 124, and side rails, and the mattress 126 includes a body that, when located on the bed frame 120, includes an upper face directed away from the surface, a lower face directed toward the surface, and sides along edges thereof. Any references to positions above the bed refer to areas above the upper face of the mattress 126 and any references to positions below the bed refer to areas below the lower face of the mattress 126. It should be understood that the bed partition device 100 is not limited to the installation described herein. Further, the bed partition device 100 may be used with various types of beds and other sleeping devices and is not limited to use with beds having the structure described herein.

Referring again to FIGS. 1 and 2, the wall 102 may have various shapes, sizes, and configurations. In this example, the wall 102 includes a substantially planar, rigid body configured to extend across an entirety of the mattress 126 between the headboard 122 and the footboard 124 of the bed. The body includes a linear, lower edge 103 configured to be located along and, optionally, rest on the upper face of the mattress 126. Oppositely disposed ends of the body extend away from the lower edge 103. Perpendicular to the lower edge 103 is a side edge 111, where the side edge 111 is positioned towards the headboard 122 of the bed frame 120 or upper end of the mattress.

An upper edge 105 of the body includes a curved profile extending between an upper portion 107 configured to be positioned closer to the headboard 122, and a lower portion 109 positioned closer to the footboard 124 of the bed. In this manner, when installed with the bed, the wall 102 may extend further upwards near the head of the individuals than the feet of the individuals. The upper portion 107 may be taller in height than the lower portion 109, thereby further promoting light and sound barriers by the head of the user. Alternatively, the wall 102 may have other shapes, such as having an upper edge 105 that is uniformly equidistant from the lower edge 103 between the ends thereof.

The wall 102 may include a single, integral body, or may be defined by two or more sections or panels 108 secured to each other. In this example, the wall 102 includes two panels 108 configured to be releasably coupled to each other at a corresponding edges thereof. Various methods and structures may be used to couple the panels 108, such as a plurality of fasteners 113, where the fasteners may be hinges, and certain connection systems. In various embodiments, the panels 108 may include fasteners 113 such as a dovetail connection wherein a first of the panels 108 includes a dovetail-shaped rib along an edge thereof and a second of the panels 108 includes a corresponding dovetail-shaped channel configured to slidably receive the dovetail-shaped rib.

In various embodiments, the wall 102 or the panels 108 thereof may include a rigid frame 110 configured to promote the structural integrity of the wall 102. In this example, the wall 102 includes a rigid frame 110 located along perimeters of each of the panels 108 and secured to edges thereof. The frame 110 may be secured to the panels 108 in various manners. In various embodiments, the frame 110 includes a U-shaped cross-section that defines a cavity configured to receive edges of the panels 108. With the edges of the panels 108 located within the cavity of the frame 110, the frame 110 may be secured to the panels 108 with fasteners, adhesives, or the like.

In various embodiments, the wall 102 is opaque or semi-opaque such that light is entirely, substantially, or partially blocked by the wall 102 and thereby prevented from radiating from one side of the wall 102 to the other. In this manner, light emitted from one of the sections of the bed (e.g., from a lamp, electronic device, flashlight, etc.) may be prevented from radiating directly toward the other section of the bed.

In various embodiments, the wall 102 includes sound damping properties sufficient to reduce sound propagation from one side of the wall 102 to the other. For example, the wall 102 may include various materials configured to reduce resonance, by absorption or redirection. In this manner, sound waves generated in one of the section of the bed (e.g., snoring, electronic devices, etc.) may be impeded from traveling directly toward the other section of the bed.

Figure 7:
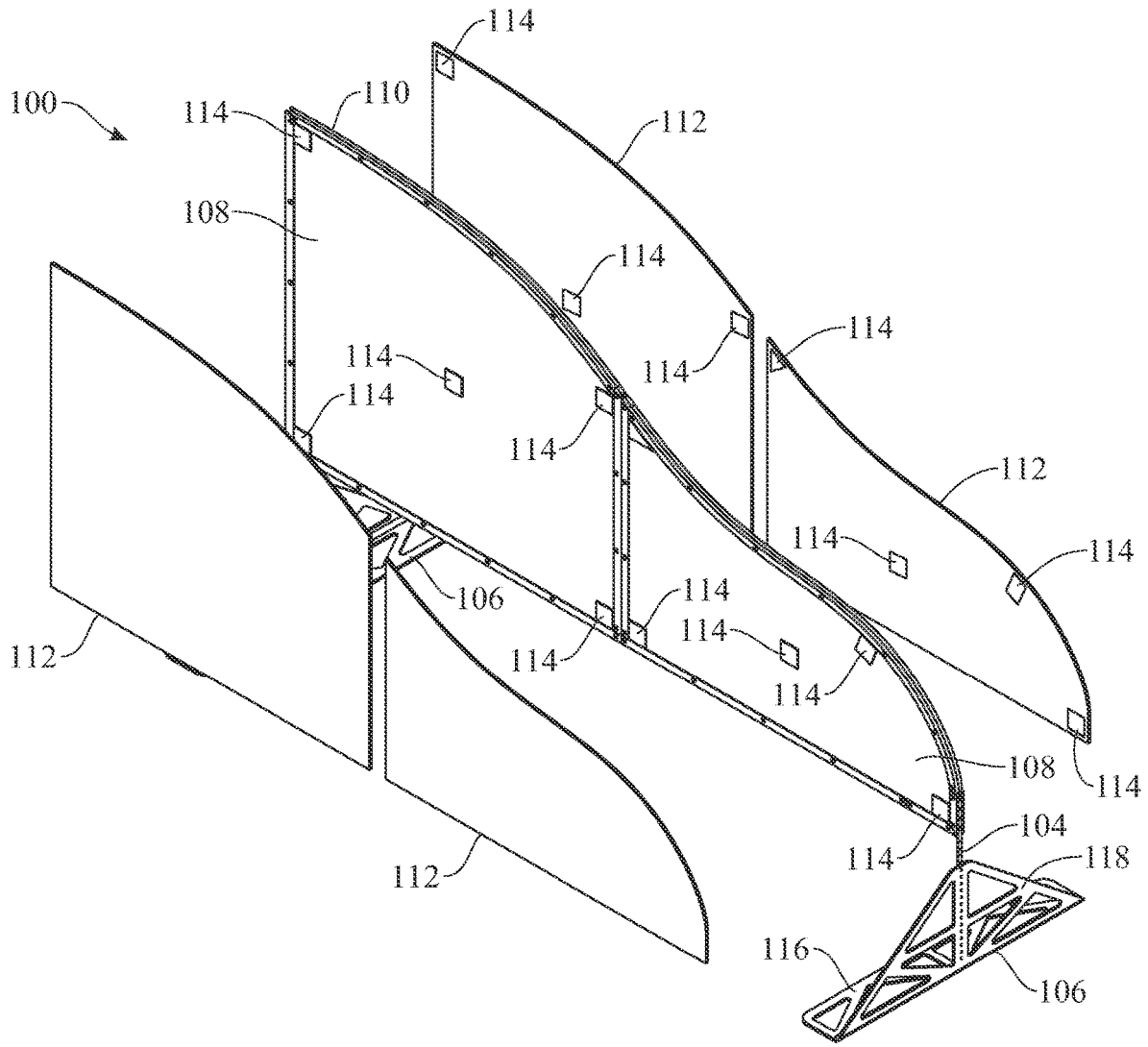
FIG. 7 presents an exploded, perspective view of the bed partition device of FIG. 1.

The light blocking and sound damping properties of the wall 102 may be properties of the panels 108 and/or properties of components permanently or releasably secured to the panels 108. In the example presented in FIG. 7, the wall 102 includes sound damping fabric members 112 secured to and covering the panels 108. The fabric members 112 may be permanently or releasably secured to the panels 108 in various manners, such as but not limited to use of certain fasteners, adhesives, etc. In this example, the fabric members 112 are releasably secured to the panels 108 with hook and loop fasteners 114. In certain embodiments, loop-type fasteners are fixed to the panels 108 and corresponding hook-type fasteners are fixed to the fabric members 112. With this arrangement, the loop-type fasteners are less likely to scratch or irritate individuals resting on the bed when the bed partition device 100 is used without the fabric members 112 secured to the panels 108.

Alternatively, the panels 108 may be void of a solid structure, and simply be comprised of the fabric members 112 to create the walled structure. The hook and loop fasteners 114 may be positioned around the edges of the panels 108 along the ridged frame 110, thereby creating a wall comprised of the fabric from the fabric members 112 rather than a rigid structure.

The wall 102 may be permanently or releasably secured to the pair of brackets 104. In this example, the pair of brackets 104 include elongated rails 115 secured to or adjacent to the ends of the wall 102 with fasteners such that the brackets 104 extend downward from the lower edge of the wall 102. The brackets 104 are configured to releasably couple with the support members 106. For example, the support members 106 may include channels 117 or slots configured to receive the elongated rails. Optionally, the rails 115 of the brackets 104 may be secured within the channels 117 or slots with a pin 119 or alternative fastener.

The support members 106 may have various shapes, sizes, and structures capable of coupling with the pair of brackets 104 and thereby supporting the wall 102 in an upright position over the bed. In various embodiments, the support members 106 may be configured to be secured directly to the bed frame 120, for example, with fasteners. In various embodiments, the support members 106 may be configured to rest on the surface below the bed (e.g., a floor). In various embodiments, the support members 106 may be configured to be pinned between the bed frame 120 and the mattress 126.

In this example, the support members 106 include a body having a first section 116 and a second section 118 that are relatively planar and oriented substantially perpendicular to each other, that is, define about a ninety-degree angle therebetween. The first section 116, referred to for convenience as the horizontal section 116, is configured to rest on a surface of the bed frame 120 that is configured to support the mattress 126 thereon. The mattress 126 may be located on the horizontal section 116 of the support members 106 such that the horizontal section 116 is between the bed frame 120 and the mattress 126. With this arrangement, the support members 106 are pinned between the bed frame 120 and the mattress 126 and the weight of the mattress 126 functions to maintain positions of the support members 106. The vertical section 118 is configured to extend upward along the edges of the mattress 126.

Figure 4:
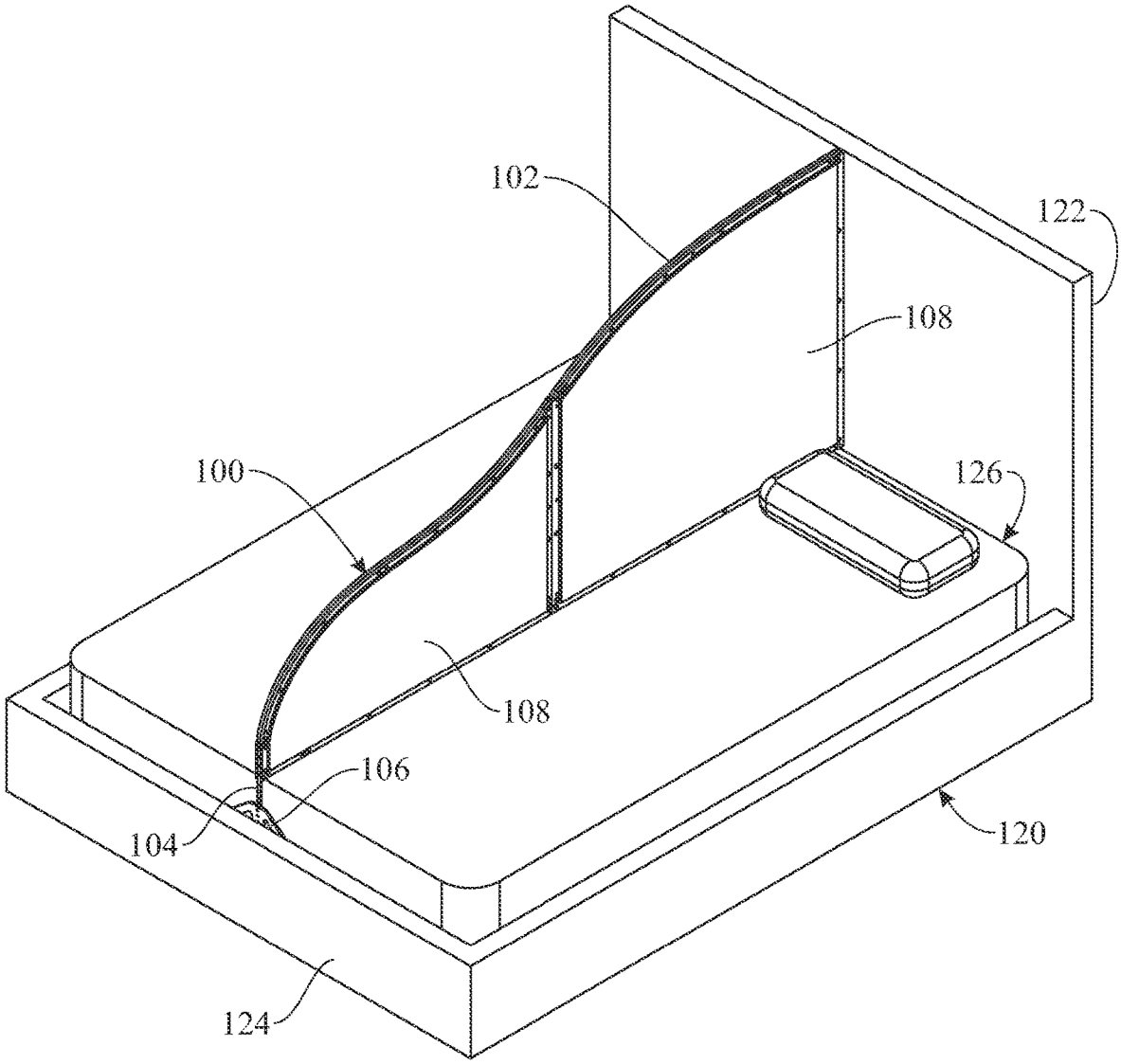
FIG. 4 presents a perspective view of the bed partition device of FIG. 1 installed on a bed.
Figure 5:
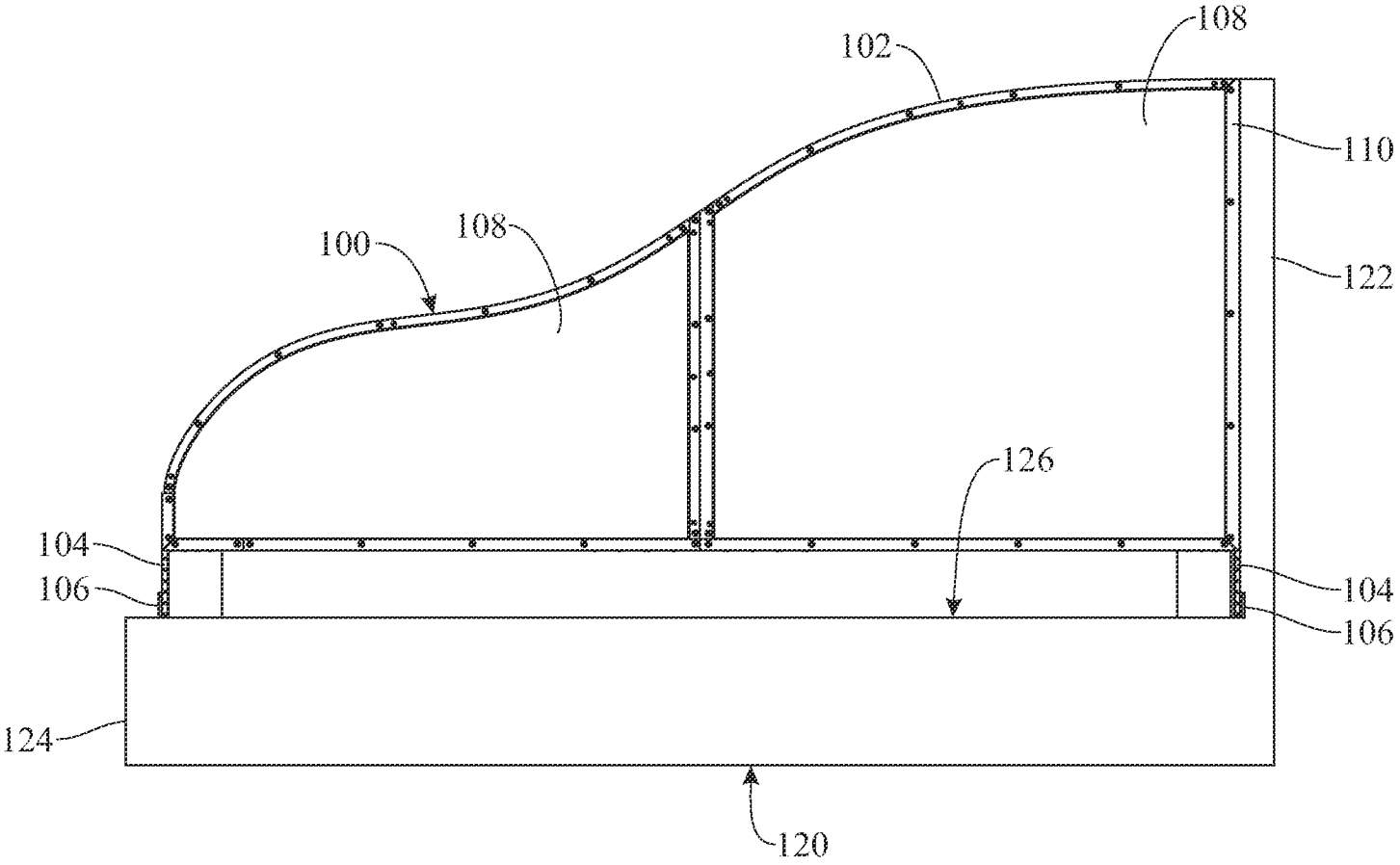
FIG. 5 presents a side view of the bed partition device of FIG. 1 installed on a bed.
Figure 6:
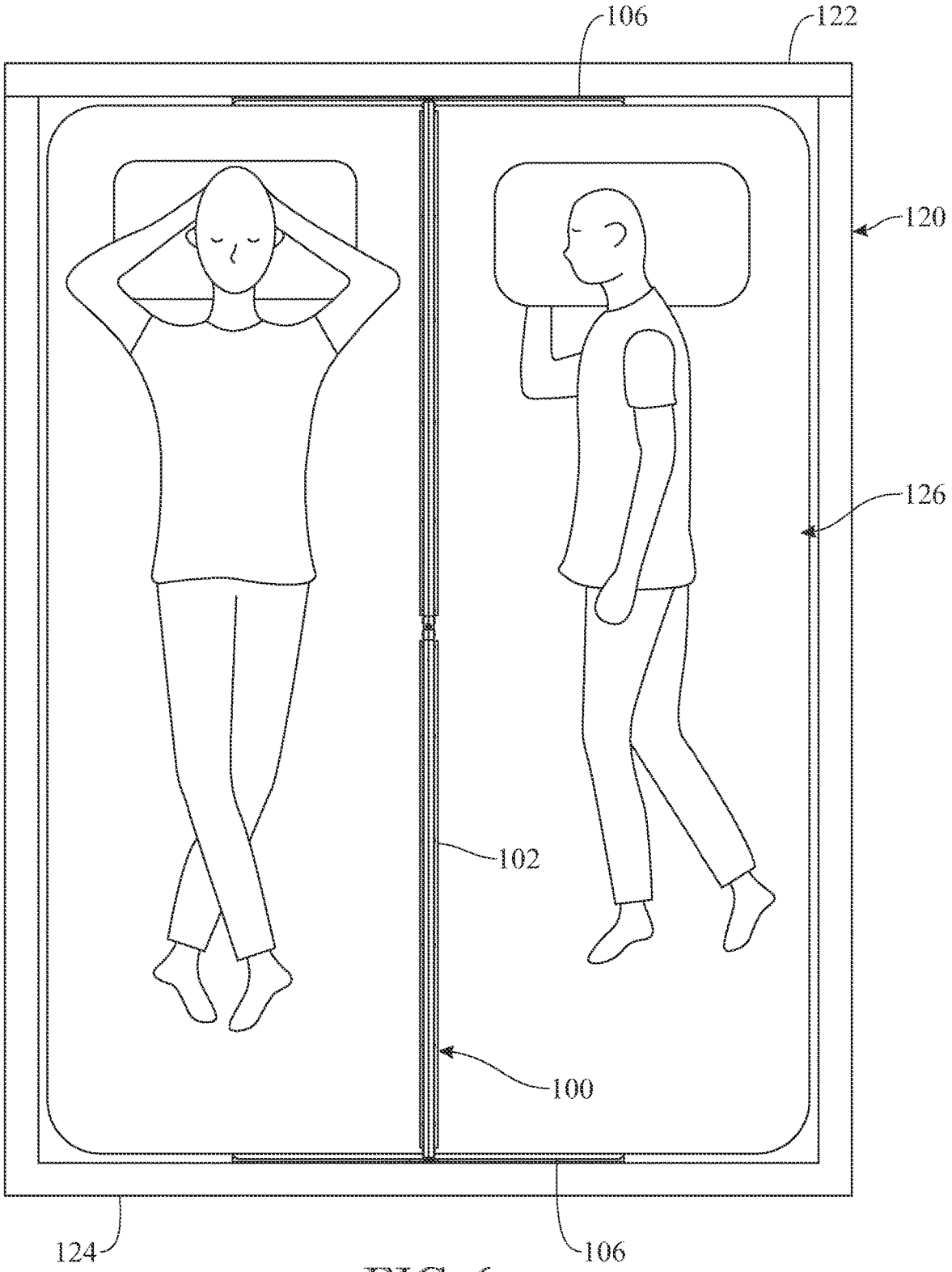
FIG. 6 presents a top view of the bed partition device of FIG. 1 installed on a bed and individuals resting in sections of the bed defined by the bed partition device in accordance with a third illustrative embodiment of the invention.

Referring to FIGS. 4-6, a method of installation of the bed partition device 100 is illustrated. Specifically, the support members 106 are located to rest on surfaces of the bed frame 120, and the mattress 126 is subsequently located on the bed frame 120 such that the support members 106 are pinned between the bed frame 120 and the mattress 126. The lower edge 103 of the wall 102 is located above and along the mattress 126 and the pair of brackets 104 are lowered between the mattress 126 and the bed frame 120 to be received within the channels 117 or slots of the support members 106. As presented in FIGS. 4-6, the support members 106 support the wall 102 in an upright position such that the wall 102 extends above the mattress 126 and separates the mattress 126 into the two sections. In various embodiments, the brackets 104 and the support members 106 are releasably coupled such that the wall 102 may be easily removed without moving the support brackets 104. With such an arrangement, the bed partition device 100 may be repeatedly installed and uninstalled as desired with minimal effort. FIG. 6 presents a pair of individuals resting in separate sections of the bed as defined by the bed partition device 100.

Alternative embodiments are contemplated in addition to the embodiments(s) shown and/or described herein. For example, the wall 102 may have shapes and constructions other than presented herein, the support members 106 and brackets 104 may function in manners other than presented herein, and/or other components of the bed partition device 100 may differ in shape, size, or structure than presented herein. Furthermore, the bed partition device 100 may include components in addition to those presented herein to complement the functionality described herein and/or provide additional functionality (e.g., reading lights, shelves, cup holders, etc.).

In various embodiments, the bed partition device 100, and/or the components thereof may include or be formed of various materials including certain polymeric, metallic, ceramic, or composite materials.

In various embodiments, the brackets 104 and the support members 106 include or are formed of rigid materials such as but not limited to certain rigid metallic and polymeric materials. In various embodiments, the brackets 104 are formed of a metallic material such as steel. In various embodiments, the support members 106 are formed of a polymeric materials such as acrylonitrile butadiene styrene (ABS).

In various embodiments, the panels 108 and/or the components secured thereto may include or be formed of various light blocking (e.g., reflecting or absorbing) and/or sound damping (e.g., reflecting or absorbing) materials. In various embodiments, the panels 108 and/or the components secured thereto may include or be formed of porous, open cell foams formed of synthetic or natural materials. In various embodiments, the panels 108 and/or the components secured thereto may include or be formed of fibrous materials (e.g., cellulose, mineral wool, fiberglass, sheep's wool, etc.). In various embodiments, the panels 108 are formed of a rigid, opaque material such as but not limited to a polycarbonate material, and fabric members 112 are coupled to the panels 108 that are formed of a sound damping material such as but not limited to vinyl, felt, or neoprene.

Figure 8:
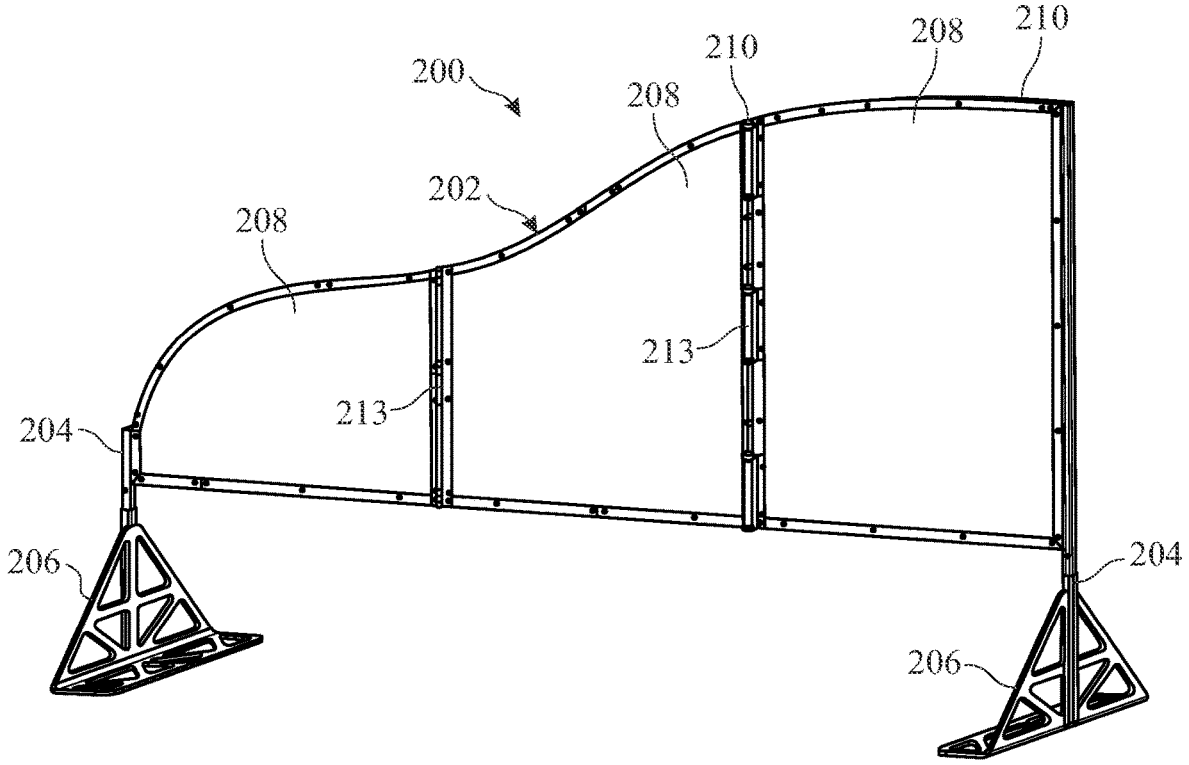
FIG. 8 presents a perspective view of the bed partition device in accordance with an alternative embodiment of the present invention.
Figure 9:
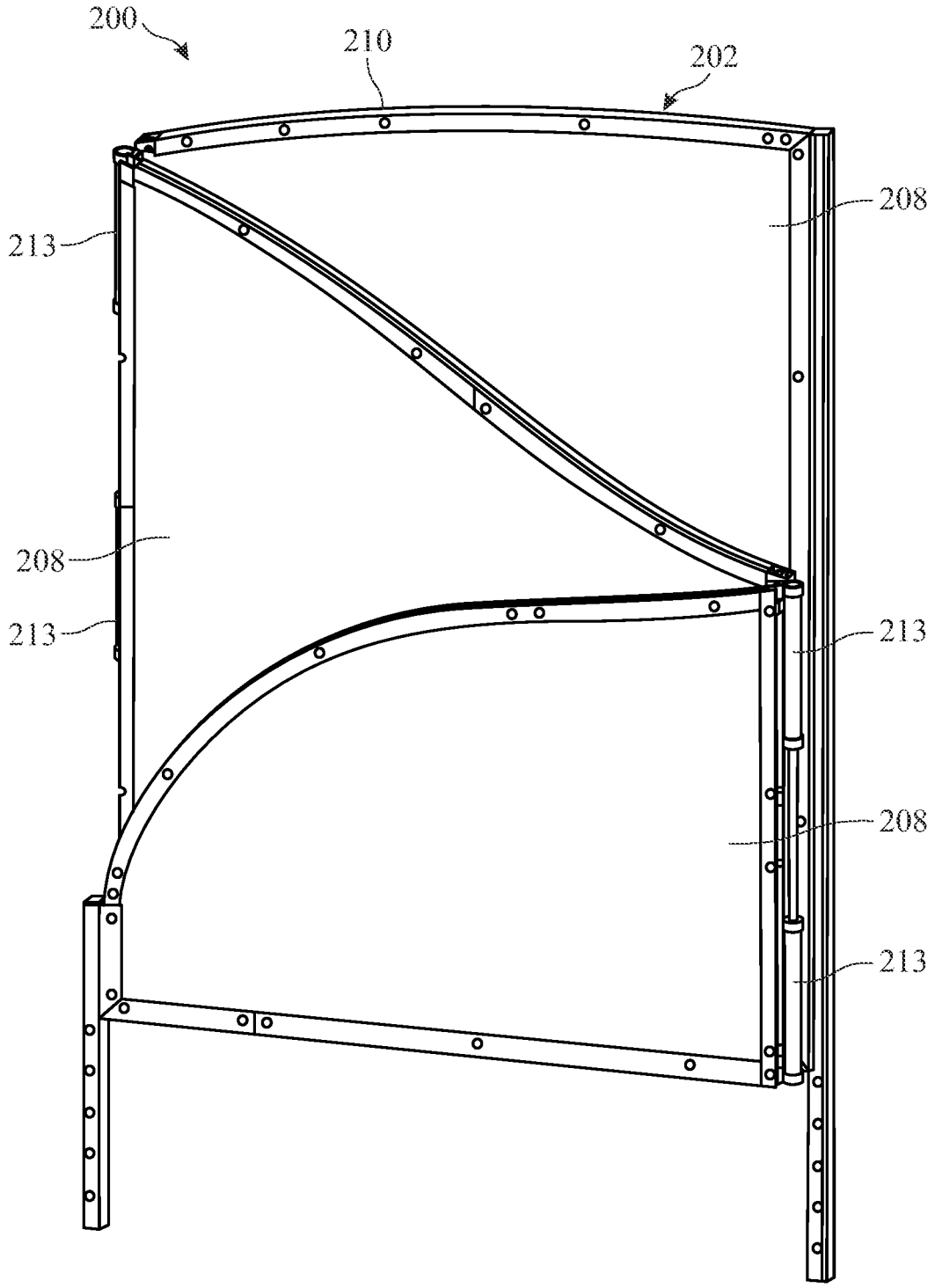
FIG. 9 presents a front view of the bed partition device of FIG. 8 in a folded position in accordance with the present invention.

Referring to FIGS. 8 and 9, the bed partition device 200 is shown in an alternative embodiment of the present invention. The bed partition device 200 includes a wall 202 comprising a similar rigid frame 210 as the first embodiment, but differs in having three panels 208 rather than two. The panels 208 are connected with a plurality of fasteners 213. The fasteners 213 may allow the rigid body 210 to bend or fold between the panels 208, which in turn allows the panels 208 to fold the rigid frame 210 upon itself to so that the panels 208 are adjacent to each other when in a folded position. The fasteners 213 may be hinges that releasably lock themselves when in the folded position. The folded position allows for easy transport and storage of the bed partition device 200 whereby the wall may be easily stored after removing the support members 206 and folding the rigid frame 210 between the partitions 208.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A bed partition device for dividing a bed into two sections, comprising: a wall having a rigid body and configured to provide acoustic dampening between the two sections of the bed, wherein the rigid body is comprised of an upper edge, a lower edge and a side edge; a pair of mounting brackets secured to the wall; and a pair of support members configured to releasably couple with the pair of mounting brackets and thereby support the wall; wherein, the brackets each include an elongated rail and the support members each include a channel configured to receive the elongated rails, and wherein the elongated rail is secured within the channel with a pin.

2. The bed partition device according to claim 1, wherein the wall includes two or more panels configured to be coupled to each other with one or more fasteners.

3. The bed partition device according to claim 2, wherein the two or more panels are coupled with a plurality of hinges, where the plurality of hinges enable the two or more panels to fold upon themselves into a folded position.

4. The bed partition device according to claim 2, wherein the two or more panels include a body formed of a polymeric material and a rigid, polymeric, metallic, or composite frame secured about a perimeter of the body.

5. The bed partition device according to claim 1, wherein the upper edge of the rigid body includes an upper portion and a lower portion, wherein the upper portion is taller than the lower portion.

6. The bed partition device according to claim 1, wherein the wall includes a fabric material releasably coupled to the rigid body thereof, and the fabric material is configured to dampen acoustics.

7. The bed partition device according to claim 5, wherein the fabric material is coupled to the rigid body of the wall with a plurality of hook and loop fasteners.

8. The bed partition device according to claim 1, wherein the support members include a first section and a second section, the first section configured to rest on a frame of the bed and have a mattress of the bed rest on the first section such that the first section is between the frame and the bed, and the second section may be configured to couple with the mounting brackets.

9. The bed partition device according to claim 8, wherein the first section and the second section are oriented substantially perpendicular to each other, and the second section is configured to extend along edges of the mattress.

10. A method for dividing a bed into two sections comprising the steps of: providing a bed partition device that includes, a wall having a rigid body and configured to provide acoustic dampening between the two sections of the bed, a pair of mounting brackets secured to the wall, and a pair of support members; locating the wall above and along a mattress of the bed such that the wall extends above the mattress and separates the mattress into the two sections, releasably coupling the pair of mounting brackets to the pair of support members, and supporting the wall above the mattress with the support members; further comprising the step of releasably coupling the pair of mounting brackets to the pair of support members by inserting an elongated rail on each mounting bracket into a channel within each support member.

11. The method for dividing a bed of claim 10, further comprising the step of assembling the wall by releasably coupling two or more panels to each other.

12. The method for dividing a bed of claim 10, further comprising the step of releasably coupling a fabric material to the rigid body of the wall, where the fabric material is configured to dampen acoustics.

13. The method for dividing a bed of claim 12, further comprising the step of releasably coupling the fabric material to the rigid body with a plurality of hook and loop fasteners fixed to the fabric material and the rigid body.

14. The method for dividing a bed of claim 10, further comprising the step of securing the support members to a frame of the bed.

15. The method for dividing a bed of claim 10, further comprising the step of positioning the support members to rest on a surface below the bed.

16. The method for dividing a bed of claim 10, wherein the support members include a first section and a second section, and the method further includes:

positioning the first section to rest on a frame of the bed, positioning a mattress of the bed to rest on the first section such that the first section is between the frame and the bed, and releasably coupling the pair of mounting brackets to the second section of the pair of support members.

17. The method for dividing a bed of claim 16, wherein the first section and the second section are oriented substantially perpendicular to each other, and the method further includes positioning the support members such that the second section extends along edges of the mattress.

18. A bed partition device for dividing a bed into two sections comprising:

a wall having a rigid body and configured to provide acoustic dampening between the two sections of the bed, wherein the rigid body is configured between an upper edge, a side edge and a lower edge;

a fabric material releasably coupled to the rigid body, wherein the fabric material is configured to dampen acoustics between the two sections of the bed;

a pair of mounting brackets secured to the wall; and a pair of support members configured to releasably couple with the pair of mounting brackets and thereby support the wall, wherein the pair of mounting brackets each include an elongated rail and the pair of support members each include a channel configured to receive the elongated rails, and wherein the elongated rail is secured within the channel with a pin.

* * * * *